US007220185B2

(12) United States Patent
Chen

(10) Patent No.: US 7,220,185 B2
(45) Date of Patent: May 22, 2007

(54) HEIGHT-ADJUSTABLE GAME TABLE

(76) Inventor: Chien-Yeh Chen, 1801, No. 7. May Tower I, May Rd., Hong Kong (CN)

( * ) Notice: Subject to any disclaimer, the term of this patent is extended or adjusted under 35 U.S.C. 154(b) by 0 days.

(21) Appl. No.: 11/247,758

(22) Filed: Oct. 12, 2005

(65) Prior Publication Data

US 2007/0083816 A1 Apr. 12, 2007

(51) Int. Cl.
*A63D 15/00* (2006.01)

(52) U.S. Cl. ..... 473/4; 473/12

(58) Field of Classification Search ..... 473/4, 473/9, 10, 12, 15; 273/309; 108/116, 130, 108/144.11

See application file for complete search history.

(56) References Cited

U.S. PATENT DOCUMENTS 2,176,255 A * 10/1939 Frost ..... 248/188.3
2,683,576 A * 7/1954 Miller ..... 248/562
3,080,835 A * 3/1963 Guglielmi ..... 108/116
3,988,021 A 10/1976 Grover
4,259,909 A 4/1981 Belina
4,315,466 A * 2/1982 Boerigter ..... 108/147
4,549,737 A * 10/1985 Seyer et al. ..... 273/118 R
4,768,781 A * 9/1988 McMillin ..... 473/16
4,907,803 A * 3/1990 Van Anda ..... 473/496
5,280,753 A 1/1994 Kavanagh
6,102,808 A * 8/2000 Wong ..... 473/12
6,644,216 B1 11/2003 Cole

* cited by examiner

*Primary Examiner*—Mitra Aryanpour
(74) *Attorney, Agent, or Firm*—Frank Marino

(57) ABSTRACT

A game table is disclosed having a support structure including leg assemblies at either end supporting the table. The support structure includes release/lock mechanisms and counterbalancing elements causing an upward force against said tabletop to substantially offset the weight of said tabletop. The leg assemblies are adapted for adjustment to facilitate vertical movement of said tabletop. The release/lock mechanisms are disposed proximate to the players normal positions to allow the players to alter the height of the tabletop without leaving their playing positions.

15 Claims, 4 Drawing Sheets

HEIGHT-ADJUSTABLE GAME TABLE

FIELD OF THE INVENTION

This invention relates to a game table. More particularly, this invention relates to a game table having an adjustable base structure for allowing adjustment of the height of the table's top. Specifically, in its preferred embodiment, this invention relates to an air hockey table with a playing surface on the tabletop that can be quickly and effortlessly adjusted by the players.

BACKGROUND AND OBJECTS OF THE INVENTION

Many recreational games are played upon a tabletop. Many tables are specifically designed to serve as a playing surface for a particular game, which game is played upon the table's top. Typical of these tables and games are pool tables for playing pool, ping-pong tables for playing ping pong, craps tables for playing craps, and air hockey tables for playing air hockey. Many of these table surfaces are large, bulky and heavy.

In such games as are played on these tables, it is generally optimal that the playing surface be located at a height that is comfortable for the players. Each table is designed so that the tabletop's height is set to best suit players of average height, but this tabletop height may be awkward for players of above or below average height.

U.S. Pat. No. 3,988,021 discloses a game table of the prior art that is provided with a pair of articulate leg structures and means for adjusting the height of the tabletop. The disclosed means includes a ratcheting mechanism that the player can use to adjust the table's height. The mechanism is cumbersome and burdensome, and requires an inordinate amount of time and effort by the user. If a player realizes during initial play that the height of the table is not optimal for his height, the player must interrupt the game, leave his playing position, and crawl dangerously underneath the heavy tabletop to actuate the ratcheting mechanism and lift the heavy top against gravity into a position that he cannot see until he returns to his playing position at tableside. It can be appreciated that it might take several attempts for the player to find a position that is optimal. It would be impractical to expect players to use this arrangement to modify the table's height for only a single or a few games of play.

It is therefore desirable and an object of the present invention to provide a game table adapted to allow players an alternative mechanism to adjust the tabletop to a height that is optimized to the players' heights.

Due to the size and weight of tabletops in general, it is an additional object to provide such a game table that allows such adjustment quickly and effortlessly.

It is a further object to provide such a table in which the height adjustment mechanism is so quick and effortless to operate that players may conveniently optimize the tabletop's height for even a single game of play.

It is still a further object to provide such a table that allows a single player to adjust the table height from a position that approximates his playing position so that he can instantly evaluate the new height without trial and error.

Further, it is an additional object to provide such a table in which the height adjustment mechanism maintains the levelness of the tabletop.

The above and other objects are addressed by the following embodiments of the present invention.

SUMMARY OF THE INVENTION

The present invention is a game table having an instant and effortless adjustment mechanism for allowing users of various heights to raise and lower the tabletop to an optimal height for their game playing. The game tables and adjustment mechanisms of the present invention represent a significant advance in the state of the art by allowing the game players, while remaining in their playing positions, to adjust the tabletop to an optimal height, and to do so while maintaining the tabletop's levelness. The game tables and adjustment mechanisms of the present invention further advance the art by providing a height adjustment mechanism that is so fast and easy as to inspire players to adjust the tabletop to an optimal height before or even during each game of play.

The present invention is disclosed in two equally preferred embodiments. In a first embodiment, a pair of telescoping towers supports the top of an air hockey table. The towers serve as legs for the table and allow the top to be raised and lowered while remaining horizontal. Pressurized air pistons in each of the towers extend between and exert a force between the floor and the tabletop to counter-balance the weight of the tabletop and allow it to be freely lifted and lowered while seeming to be virtually weight-free to the player. Pedal-operated lock and release mechanisms are positioned at the bases of the towers facing the ends of the table where the players would normally stand during play. These pedals allow the players to release the normally locked mechanisms and lift or lower the table with the touch of a finger, and to lock the table into the most desirable of a number of discrete heights, all while standing in their normal playing positions at the ends of the table. Such a mechanism could easily be adapted to any game-playing table regardless of the weight of the tabletop, such as pool table, simply by employing an appropriately strong air piston.

In a second embodiment, two diverging pairs of legs are positioned under the top of an air hockey table. A pressurized air piston extends between and exerts a force between one of the pairs of legs and the tabletop to counter-balance the weight of the tabletop and allow it to be freely lifted and lowered while seeming virtually weight-free. The leg pairs are connected by gearing so that, as the top is raised and lowered, the angle between the table top and each pair of legs changes equally to maintain the tabletop's horizontal disposition. A hand-operated lock and release mechanism is positioned at the underside of the tabletop at an end where a player would normally stand during play. This allows a player to release the normally locked mechanism and lift or lower the table with the touch of a finger, and to lock the table at any one of an infinite number of heights, all while standing in a normal playing position at an end of the table. Such a mechanism could also be easily adapted to many game playing tables.

A complete appreciation for the various features and advantages of the present invention will be had by those skilled in the appropriate arts upon review of the following complete description of these two most preferred embodiments.

DESCRIPTION OF THE PREFERRED EMBODIMENT OF THE INVENTION

Figure 1:
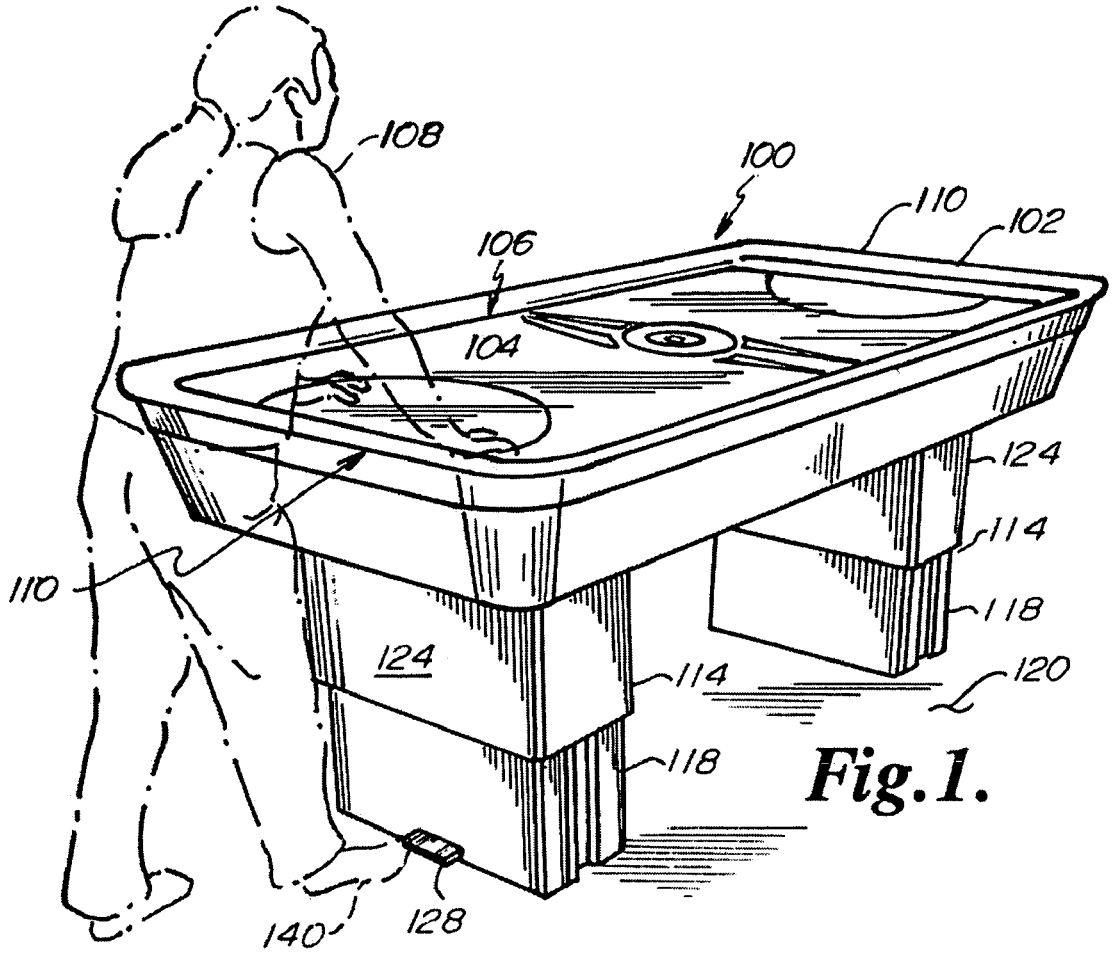
FIG. 1 is a perspective view of an air hockey table in accordance with a first preferred embodiment of the invention showing a player (in phantom lines) in a typical playing position and actuating the pedal-operated lock and release mechanism.
Figure 2A:
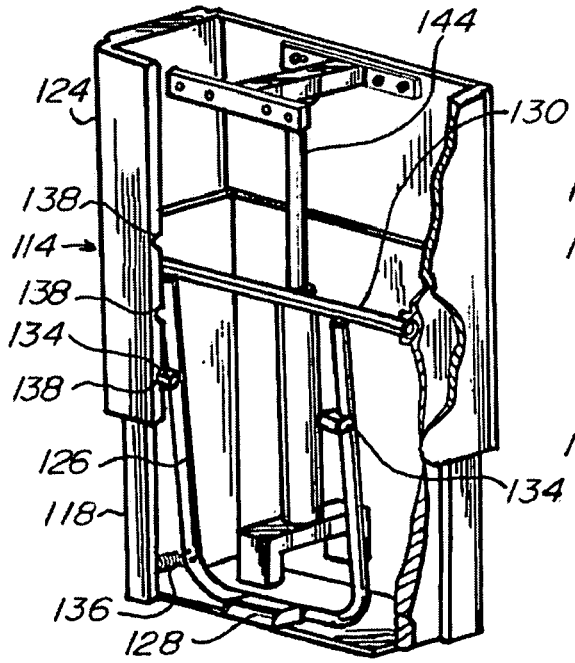
FIG. 2A is a cutaway view of a tower of the table of FIG. 1 with the lock and release mechanism in its normally locked position and the tower adjusted for the highest tabletop position.
Figure 2B:
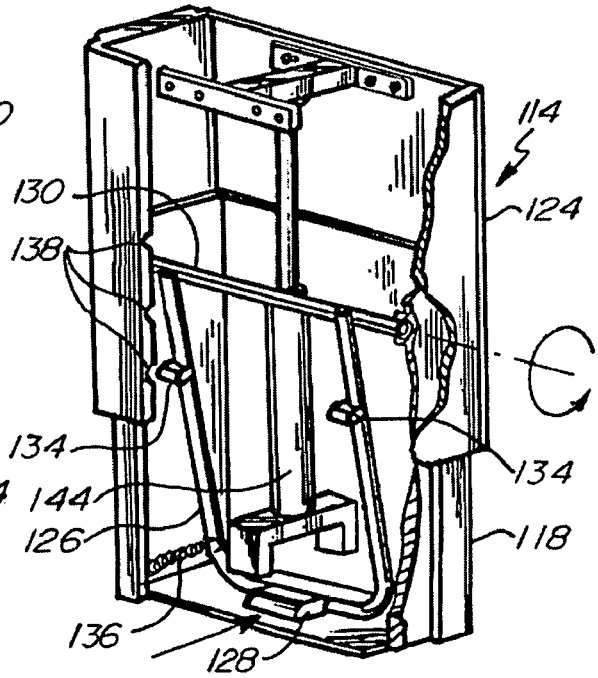
FIG. 2B is a cutaway view of the tower of FIG. 2A with the lock and release mechanism pushed into its unlocked position.
Figure 2C:
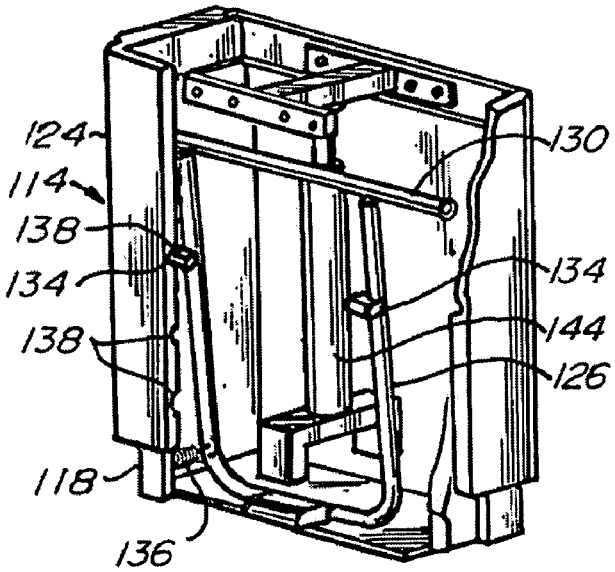
FIG. 2C is a cutaway view of the tower of FIGS. 2A and 2B with the lock and release mechanism returned to its normally locked position and the tower adjusted for the lowest tabletop position.
Figure 3:
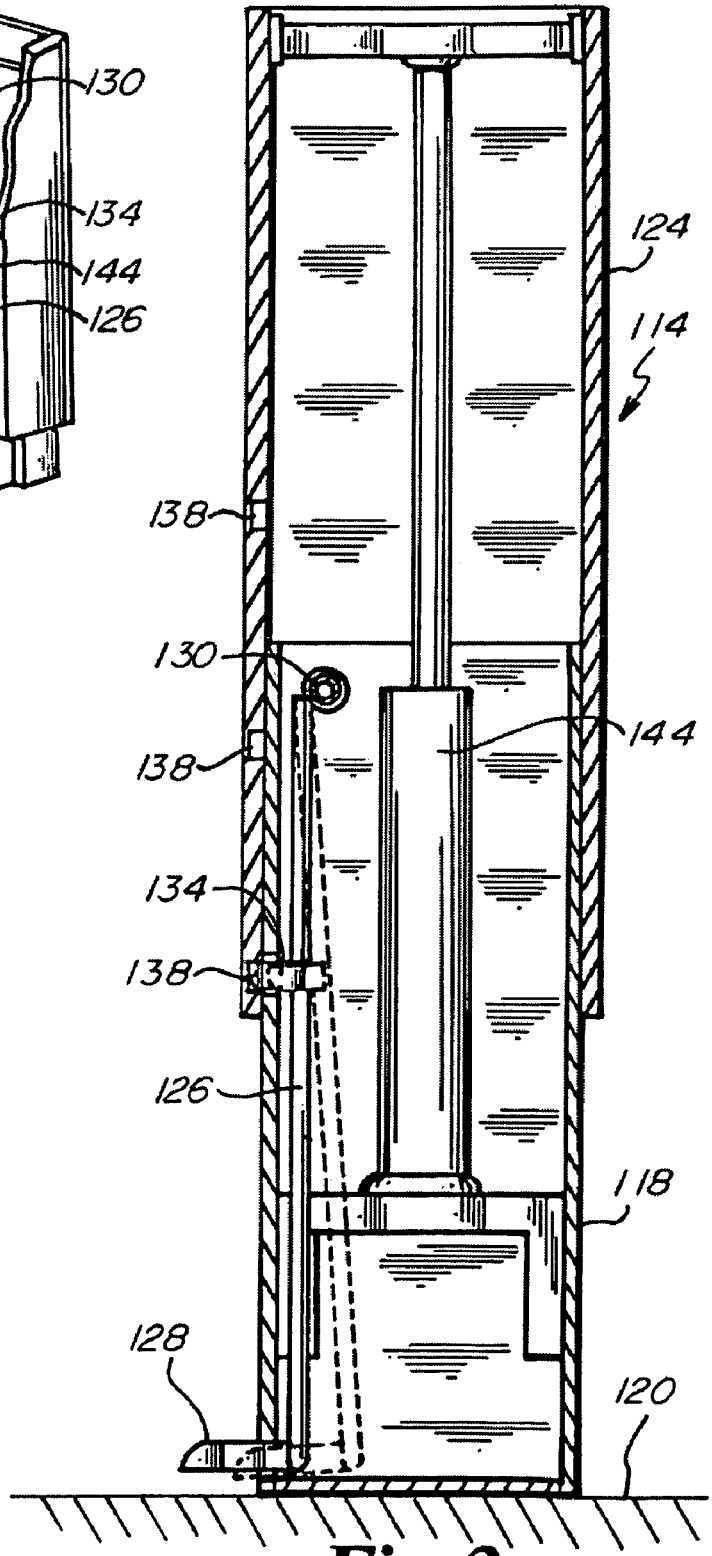
FIG. 3 is a cross-sectional view through the tower of FIGS. 2A–2C with the lock and release mechanism shown in its normally locked position and the tower adjusted for the highest tabletop position and the mechanism shown in phantom pushed into its unlocked position.
Figure 4:
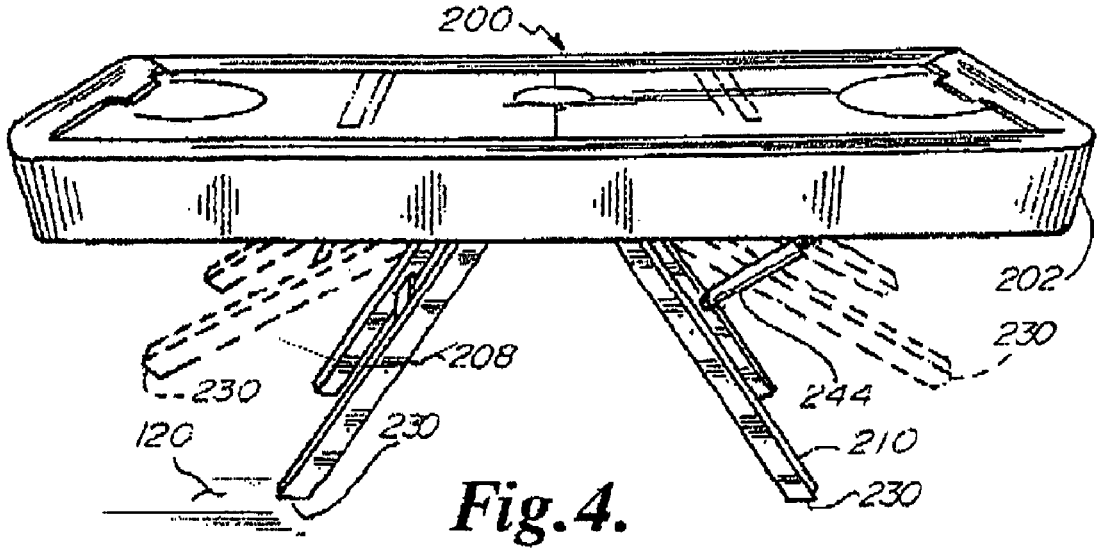
FIG. 4 is a side view of an air hockey table according to a second preferred embodiment of the invention with the tabletop shown in its highest position and shown in phantom in its lowest position.
Figure 5:
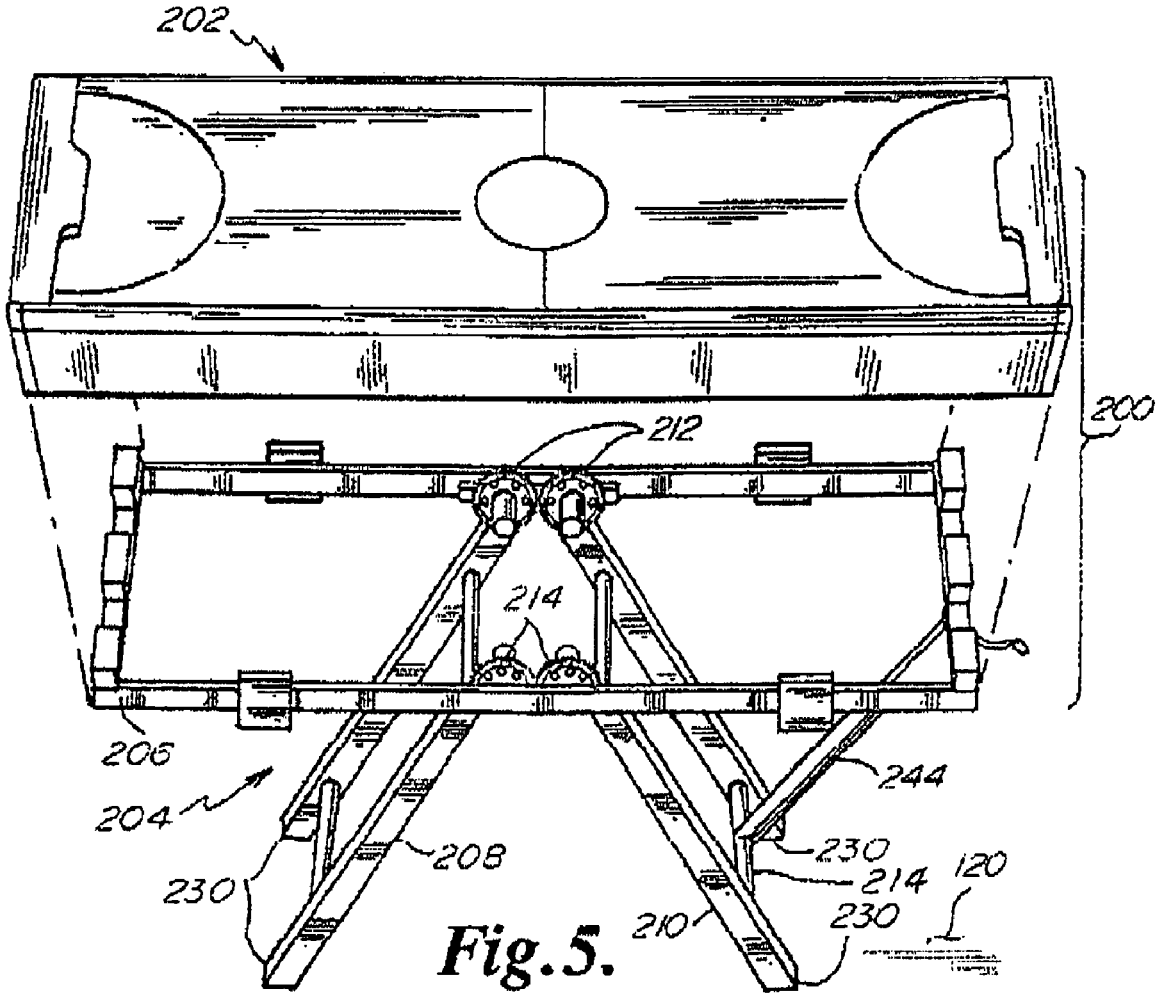
FIG. 5 is a top perspective view of the table of FIG. 4 with the tabletop exploded from the base assembly.
Figures 6A, 6B, 6C:
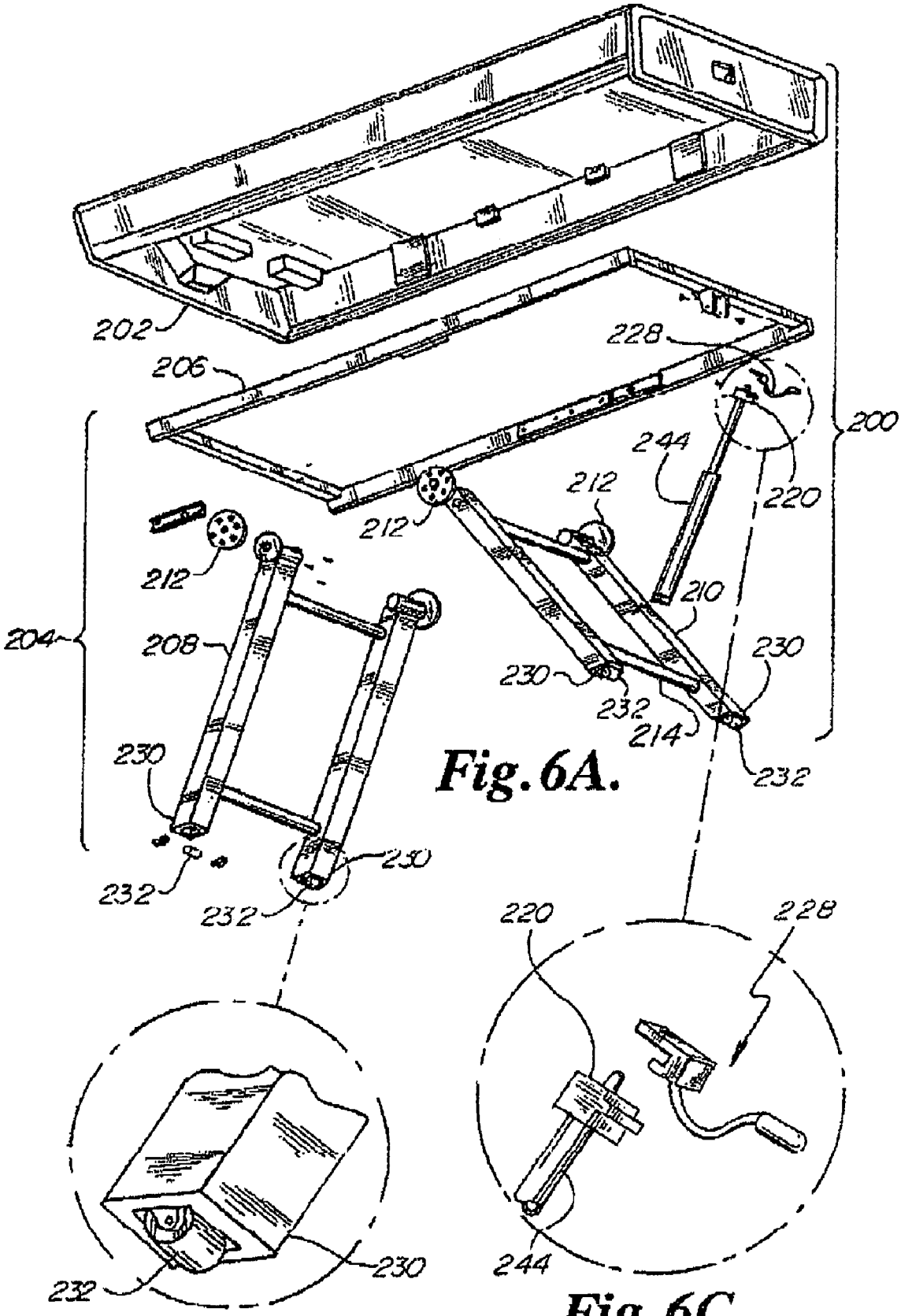
FIG. 6A is an exploded view from below of the table of FIG. 4.
FIG. 6B is a close-up view of a typical rolling foot of the table of FIG. 4.
FIG. 6C is a close up exploded view of the hand-operated actuator of the lock and release mechanism of the table of FIG. 4.

Referring now to the drawings, FIG. 1 through FIG. 3 depict an air hockey table 100 having a tabletop 102 which is adapted with a horizontally disposed playing surface 104. The perimeter of the tabletop includes a retaining wall 106 to keep the game puck (not shown) on the playing surface. A player 108 normally stands at each end 110 of the table as shown in phantom in FIG. 1.

The tabletop 102 is supported by two towers 114. Each tower is comprised of a stationary lower inner tower member 118, which remains on the floor 120 and a vertically movable upper outer tower member 124, which is rigidly connected to the tabletop 102. The lower inner tower members 118 fit loosely within the upper outer tower members 124 to allow the upper tower members to be raised and lowered relative to the lower members with no substantial tilting or twisting.

Rigid U-shaped pedal support 126 is pivotally connected to and disposed within the lower inner tower member 118. Support 126 includes pedal 128, pivot bar 130, and locking elements 134. The pedal support is free to swing about the pivot bar, which is pivotally connected to tower member 118. The pedal support is biased by extension spring 136 into the "locked" position shown in FIGS. 2A and 2C, wherein locking elements 134 protrude through openings 138 in the upper outer tower member 124 to deny the raising and lowering of member 124 relative to member 118.

When pedals 128 of both towers 114 are pushed inwardly by each player's foot 140 into the "released" position of FIG. 2B, locking elements 134 are moved out of openings 138 and tower member 124, and therefore the tabletop 102 to which tower 124 is rigidly attached, is free to be raised and lowered.

It is anticipated that numerous alternatives to the locking elements shown may be substituted within the scope of the invention; for instance, such locking elements may take the form of magnets, which are brought against the upper outer tower member during the "locked" position. Or the locking elements may be in the form of cylindrical pins protruding from the U-shaped pedal support into round holes in the upper outer tower member. In whatever form, the locking elements need simply to create interference that denies relative vertical movement between the upper and lower tower members in order that they serve their intended purpose within the scope of the invention.

Further, it is anticipated that the U-shaped pedal support with its locking elements and pedal could be disposed within the upper outer tower member and could move up and down with that upper outer tower member. Provided that the locking action denies relative vertical movement between the upper and lower tower members and therefore to the tabletop, the essence of this feature of the invention is realized.

Air piston 144 is pre-pressurized and therefore adapted to exert an upwardly and downwardly extending force between the lower inner tower member 118 and upper outer tower member 124. This force offsets the weight of the tabletop 102 to minimize the effort required to raise and lower the tabletop. Alternatively, a compression spring or some similar counter-balancing means may be used in place of the air piston to offset the weight of the tabletop.

As can be seen in FIG. 1, player 108 may easily push pedal 128 into the "released" position of FIG. 2B without moving substantially from his typical playing position. Having done so, both players can raise the tabletop 102 with the assistance of the lifting force of piston 144 to counter-balance the tabletop's weight, or can lower the tabletop with the assistance of gravity to offset the piston's force, all while remaining in their normal playing positions. By simply removing the foot 140 from pedal 128, as the tabletop nears the desired vertical position, the tabletop will become locked into that position. This allows the players to remain in their normal playing positions and thereby more conveniently select a tabletop height that is most optimal for playing.

Because the array of openings 138 are at the same vertical locations on both upper outer tower members, the tabletop is automatically leveled into a horizontal position after repositioning.

Turning now to FIGS. 4 through 6C, another air hockey table 200 is shown according to a second preferred embodiment of the invention. Tabletop 202 rests on a support structure 204 that comprises frame 206 and two pairs of support legs; free leg pair 208 and locking leg pair 210. Leg pairs 208 and 210 are pivotable relative to frame 206 to effectively raise and lower frame 206, and therefore raise and lower tabletop 202 from floor 120. Leg pairs 208 and 210 are connected to each other by gearing 212 to ensure that their angular relationships to frame 206 are always equal, thereby ensuring that the tabletop 202 remains in a substantially horizontal disposition as it is raised and lowered.

Air piston 244 is pre-pressurized and therefore adapted to exert an upwardly and downwardly extending force between the tabletop 202 and the locking leg pair 210 at cross member 214. This force offsets the weight of the tabletop 202 to minimize the effort required to raise and lower the tabletop. Valve 220 locks piston 244 in its present state of extension when the valve is in its "locked" position and releases the piston to be free to extend under its own pressure or to be compressed when the valve is in its "released" position.

When valve actuator 228 is pushed downwardly by a player's hand (not shown), valve 220 is caused into its "released" position, and the player can raise the tabletop 202 with the assistance of the lifting force of piston 244 to counter-balance the tabletop's weight, or can lower the tabletop with the assistance of gravity to offset the piston's force, all while remaining in his typical playing position. By simply removing his hand from actuator 228, as the tabletop reaches the desired vertical position, the tabletop will become locked into that position. This allows the user to remain in a normal playing position and thereby more simply select a position that is most optimal for playing.

As the tabletop 202 is lifted and lowered and the angular relationship of leg pairs 208 and 210 to frame 206 is changed, the lower portions 230 of each leg are accordingly forced closer together or farther apart. Rollers 232 at the bottom ends of each leg allow the legs to roll smoothly on the floor as the relationship of the legs changes.

In an alternative embodiment (not shown) of the above-described table, the free leg pair is replaced by a second locking leg pair, including a second valve and air piston. In such an embodiment, two players standing at opposite ends of the table, both in their usual playing positions, simultaneously actuate the valves at their ends and cooperate to lift or lower the tabletop together. Such an embodiment is, of course, within the scope of the present invention.

It is also anticipated that there could be various arrangements for the two pairs of support legs of the second preferred embodiment while remaining within the scope of the invention. For instance, the legs pairs might be adapted to fold during the "released" position of the valve to effectively increases or reduce their heights. In such arrangement, the air piston may be disposed between the folding points of the leg pairs or may remind as disclosed above, between the locking leg pair and the tabletop.

Or the leg pairs may be disposed in a criss-crossing configuration, pivotally connected near to their mid-points and adapted at their top ends for horizontal movement relative to the tabletop as the angle between the leg pairs is adjusted to cause the vertical movement of the tabletop.

As can be appreciated, the present invention may take many forms without departing from its intended scope, that being a tabletop lifting and lowering mechanism that 1) counterbalances the weight of the tabletop, making lifting and lowering less laborious, 2) maintains the levelness of the tabletop despite its vertical repositioning, 3) allows one or more players to remain in their playing positions during the raising and lowering process, and 4) thereby makes practical and convenient the proper height re-adjustment of the game surface prior to every game of play.

Further, the present invention is sturdy, simple and can be easily fabricated. And the invention can be used in connection with game tables of various types.

It should therefore be understood that the scope of the invention should only be limited by the following claims.

I claim:

1. A game table comprising:

a tabletop having a substantially horizontal disposition and adapted for playing a particular game thereon by one or more players stationed in one or more playing positions adjacent to said game table;

a support structure comprising first and second leg assemblies supporting said tabletop at opposite ends thereof, One or more release/lock mechanisms, and One or more counterbalancing elements comprising one or more pre-pressurized air cylinders affixed to said tabletop and said support structure;

wherein said leg assemblies are adapted for adjustment to facilitate vertical movement of said tabletop;

said leg assemblies are adapted to cooperate with each other to maintain said tabletop in said horizontal disposition after said adjustment;

said one or more release/lock mechanisms are each movable between a first condition and a second condition, denying said adjustment of said leg assemblies when in said first condition and allowing said adjustment when in said second condition;

wherein said one or more pre-pressurized air cylinders are biased by their pre-pressurization to impart an upward force against said tabletop to substantially offset the weight of said tabletop and said table top is rendered virtually weightless due to the balance between the downward force of the tabletop's weight and the upward force of the one or more pre-pressurized air cylinders when said one or more release/lock mechanisms are in said second condition;

and said one or more release/lock mechanisms are disposed proximate to said one or more playing positions to allow the one or more players, while remaining substantially in their playing positions, to move said release/lock mechanisms from said first condition to said second condition, to adjust said leg assemblies to facilitate said vertical movement of said tabletop, and to move said release/lock mechanisms back to said first condition to thereby fix said tabletop in a new vertical position.

2. The game table of claim 1 wherein said first and second leg assemblies comprise vertically telescoping towers and said adjustment is realized through a vertical telescoping action.

3. The game table of claim 2 wherein said one or more release/lock mechanisms comprise one or more locking elements adapted for rigidly fixing one or more of said vertically telescoping towers during said first condition to deny said telescoping action.

4. The game table of claim 3 wherein said one or more locking elements are moved from said first condition to said second condition by a foot-operated actuator.

5. The game table of claim 4 wherein each of said one or more air cylinders is disposed within one of said vertically telescoping towers.

6. The game table of claim 5 wherein each of said one or more release/lock mechanisms is disposed within one of said vertically telescoping towers and comprises one or more locking elements rigidly fixing said one of said vertically telescoping towers during said first condition to deny said vertical telescoping action.

7. The game table of claim 1 wherein at least a portion of said first and second leg assemblies comprise first and second rigid pairs of legs, each of said pairs being pivotable relative to said tabletop about a horizontal pivot axis, and said vertical movement of said tabletop is facilitated by a horizontal pivoting of both of said pairs.

8. The game table of claim 7 wherein said one or more pre-pressurized air cylinders each has a variable length and is biased to increase said variable length to cause said upward forcelength and biased to increase said variable length to cause said upward force.

9. The game table of claim 8 wherein said release/lock mechanism comprises one or more valves having first and second selectable conditions, and wherein said one or more valves denies variation in said variable length of said pressurized air cylinder during said first condition to thereby deny said vertical movement of said tabletop, and allows variation in said variable length of said pressurized air cylinder during said second condition to thereby allow said vertical movement of said tabletop.

10. The game table of claim 9 wherein said release/lock mechanism is disposed between one of said first and second rigid pairs of legs and said tabletop.

11. The game table of claim 10 wherein said first and second rigid pairs of legs are mechanically linked such that each of said pair's pivotal relationship to said tabletop is always the same as the other pair's pivotal relationship to said tabletop

12. The game table of claim 11 wherein said first and second rigid pairs of legs are mechanically linked by gearing.

13. A method of varying the height of a game table's tabletop by one or more players stationed in playing positions adjacent to said game table, said tabletop having a substantially horizontal disposition and said table comprising:

a support structure comprising first and second leg assemblies supporting said tabletop at opposite ends thereof, one or more release/lock mechanisms, and one or more counterbalancing elements comprising one or more pre-pressurized air cylinders affixed to said tabletop and said support structure;

wherein said leg assemblies are adapted for adjustment to facilitate vertical movement of said tabletop;

said leg assemblies are adapted to cooperate with each other to maintain said tabletop in said horizontal disposition throughout said adjustment;

said one or more release/lock mechanisms are each movable between first and second conditions, denying said adjustment of said leg assemblies when in said first condition and allowing said adjustment when in said second condition;

and wherein said one or more pre-pressurized air cylinders are biased by their pre-pressurization to impart an upward force against said tabletop to substantially offset the weight of said tabletop and said table top is rendered virtually weightless due to the balance between the downward force of the tabletop's weight and the upward force of the one or more pre-pressurized air cylinders when said one or more release/lock mechanisms are in said second condition;

and said one or more release/lock mechanisms are disposed proximate to one or more of said playing positions;

wherein said method comprises;

a first movement by one or more of said one or more players, while remaining substantially in said his said playing position, of said one or more release/lock mechanisms from said first position to said second position, an adjustment by said one or more of said one or more players, while remaining substantially in his said playing position, of said leg assemblies to facilitate said vertical movement of said tabletop and a second movement by said one or more of said one or more players, while remaining substantially in his said playing position, of said one or more release/lock mechanisms back to said first position to fix said tabletop in a new vertical position.

14. The method of claim 13 wherein each of said one or more release lock mechanism comprises a foot pedal and said first and second movements of said one or more release/lock mechanisms is accomplished by one of said one or more players' feet against said pedal.

15. The method of claim 13 wherein said one or more release lock mechanisms comprise a valve, and wherein each valve has a valve actuator adapted to cause said valve into said first or second conditions, each valve actuator disposed at the table top and proximate said one or more players, and wherein said first and second movements of said one or more release/lock mechanisms is accomplished by the hands of said one or more players against said one or more valve actuators.

* * * * *